United States Patent [19]

Golczewski et al.

[11] 4,289,624

[45] Sep. 15, 1981

[54] APPARATUS FOR EXTRACTING SOLIDS FROM SLURRY

[76] Inventors: Roman Golczewski, 19 Primrose Ave., Ryde 2112, N.S.W.; Barry G. Seach, 92 Cecil Ave., Castle Hill, 2154; Solomon E. Cohen, 46A Epping Ave., Eastwood, N.S.W., all of Australia

[21] Appl. No.: 20,534

[22] Filed: Mar. 14, 1979

[30] Foreign Application Priority Data

Mar. 20, 1978 [AU] Australia ..... 3757

[51] Int. Cl.[3] ..... B01D 33/06

[52] U.S. Cl. ..... 210/404

[58] Field of Search ..... 210/402, 404, 406, 395

[56] References Cited

U.S. PATENT DOCUMENTS

| | | | |
|---|---|---|---|
| 3,125,514 | 3/1964 | Frykhult | 210/404 |
| 3,233,736 | 2/1966 | Vernay | 210/406 |
| 3,409,139 | 11/1968 | Jackson et al. | 210/404 |
| 3,587,863 | 6/1971 | Kristofl | 210/404 |
| 3,638,798 | 2/1972 | Basfield et al. | 210/404 |
| 4,001,119 | 1/1977 | Hunter | 210/404 |
| 4,142,976 | 3/1979 | Browne | 210/406 |

*Primary Examiner*—Theodore A. Granger

*Attorney, Agent, or Firm*—Weingarten, Maxham & Schurgin

[57] ABSTRACT

This invention relates to apparatus for the extraction of solids from a liquid slurry or suspension of a type in which a reduced pressure chamber applies suction to a zone on one side of a sieve surface whereby solids may be urged against a corresponding zone on the other side and the liquid is urged to flow through the sieve into the chamber. The invention provides means for transporting liquid from the chamber in discrete amounts while substantially maintaining reduced pressure in the chamber. In preferred embodiments the sieve is cylindrical and rotates, vanes are attached to the chamber side of the sieve carry the water out of the chamber in inter-vane spaces, while slipper pads provide a seal with vane tips to maintain reduced pressure in the chamber.

22 Claims, 3 Drawing Figures

APPARATUS FOR EXTRACTING SOLIDS FROM SLURRY

FIELD OF THE INVENTION

This invention relates to apparatus for the extraction of solids from a liquid slurry or suspension useable, for example, for the production of asbestos fibre cement pipes and sheets or other fibre pipes or sheets.

Conventionally such apparatus comprises a cylindrical sieve which is rotated whilst partially submerged in a vat containing a slurry of fibres, cement and other additive materials.

The liquid component of the slurry drains through the mesh skin of the cylindrical sieve. The solids component of the slurry is retained on the surface of the sieve external of the cylinder. The liquid components, effluent water, is discharged from one end or both ends of the sieve. The layer of solids adhering to the mesh is typically removed, after it emerges from the slurry by rotation of the cylinder, by transference from the cylinder to a felt belt held in contact with the layer of solids at the top of the cylinder by a couch roll.

The production rate of such a machine depends on the rate of increase in thickness of the layer that can be produced upon the surface of the cylinder as this determines the sieve's speed of rotation; the mesh size of the sieve is dictated by the type of fibre and the fineness of the solids which is has to retain and thus very few modifications may be made to the mesh size to increase the rate of filtration in order to increase the rapidity of solids built up. Thus it has been recognised as desirable to increase the differential pressure of head between the inside and outside of the sieve so that the filtration rate may be increased.

Various expedients have been devised to increase the rate of filtration. The commonest one is to divide the interior of the cylindrical sieve into discrete zones by means of stationary, internal radially extending partitions and to reduce the internal pressure in the zone of layer formation. Hitherto the effect of that reduction has been reduced by the presence of substantial quantities of effluent water within that zone of the sieve; such effluent water being present in quantity because of the difficulty of draining it from one end or both ends of the zone whilst at the same time maintaining a reduced air pressure within the zone.

BRIEF SUMMARY OF THE INVENTION

An object of the present invention is to ameliorate that difficulty by increasing the rate of removal of effluent water from the layer forming zone of the sieve.

According to preferred embodiments the invention achieves the object by providing a sieve provided on the inner surface of its cylindrical mesh wall with a plurality of vanes able to trap effluent water and carry it with the movement of the sieve beyond the layer forming zone of the sieve, for delivery to an outlet launder in a non-layer forming zone of the sieve.

According to a first aspect the invention consists of apparatus for separating solids from a suspension of said solids in a liquid, comprising, a sieve permitting passage therethrough of said liquid whilst substantially retaining on a surface thereof said solids, means for feeding said suspension to a zone on one side of said sieve, at least one reduced pressure chamber for applying suction to a corresponding zone on the other side of said sieve whereby said solids are urged against said surface and said liquid is urged to flow therethrough, conveyance means whereby liquid that has flowed through the said sieve to said other side is transported in discrete amounts from said chamber and sealing means whereby reduced pressure may be substantially maintained in said chamber notwithstanding said transportation therefrom of said liquid.

BRIEF DESCRIPTION OF THE DRAWINGS

By way of example an embodiment of the above described invention is described hereinafter with reference to the accompanying drawings in which.

DETAILED DESCRIPTION OF PREFERRED EMBODIMENTS

Figure 1:
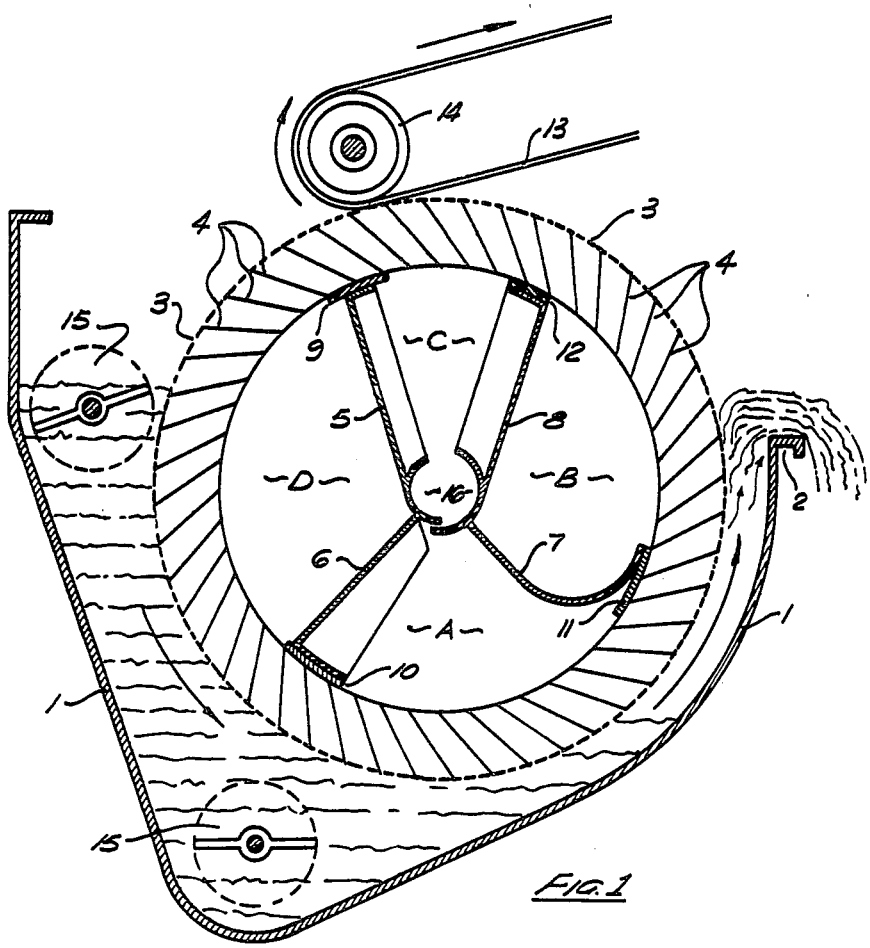
FIG. 1 is a diagrammatic cross-sectional view of a first embodiment of a vacuum sieve.
Figure 2:
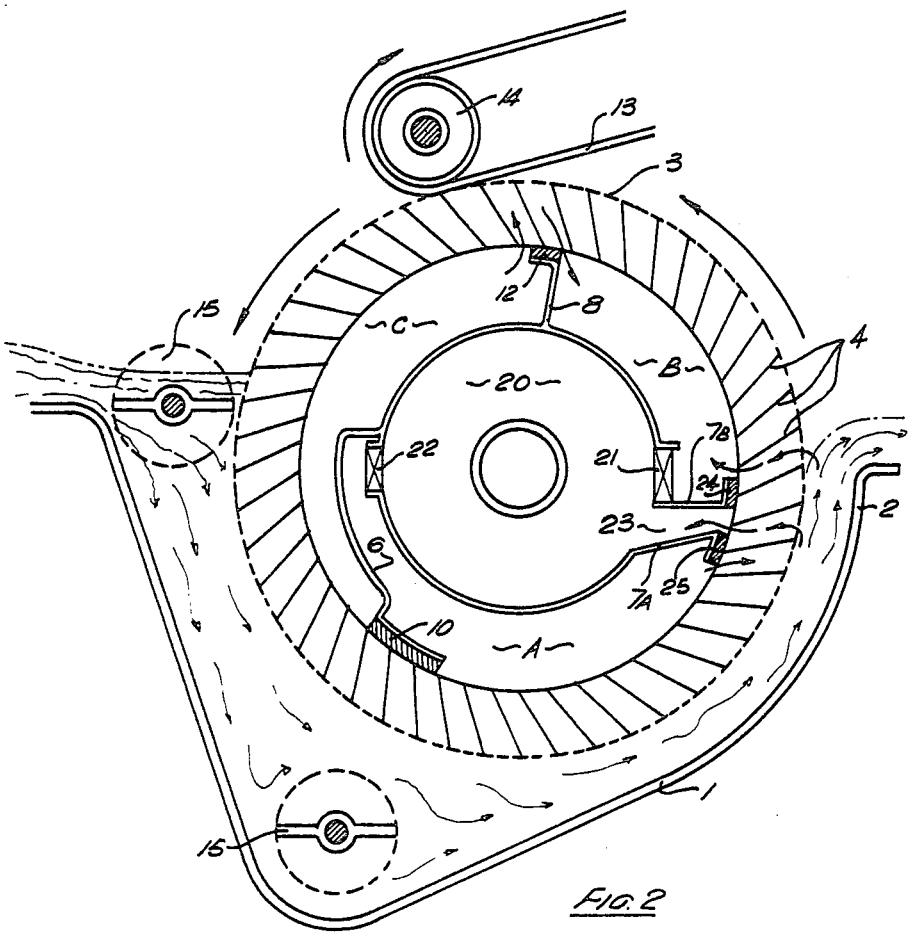
FIG. 2 is a diagrammatic cross-sectional view of a second embodiment of a vacuum sieve.
Figure 3:
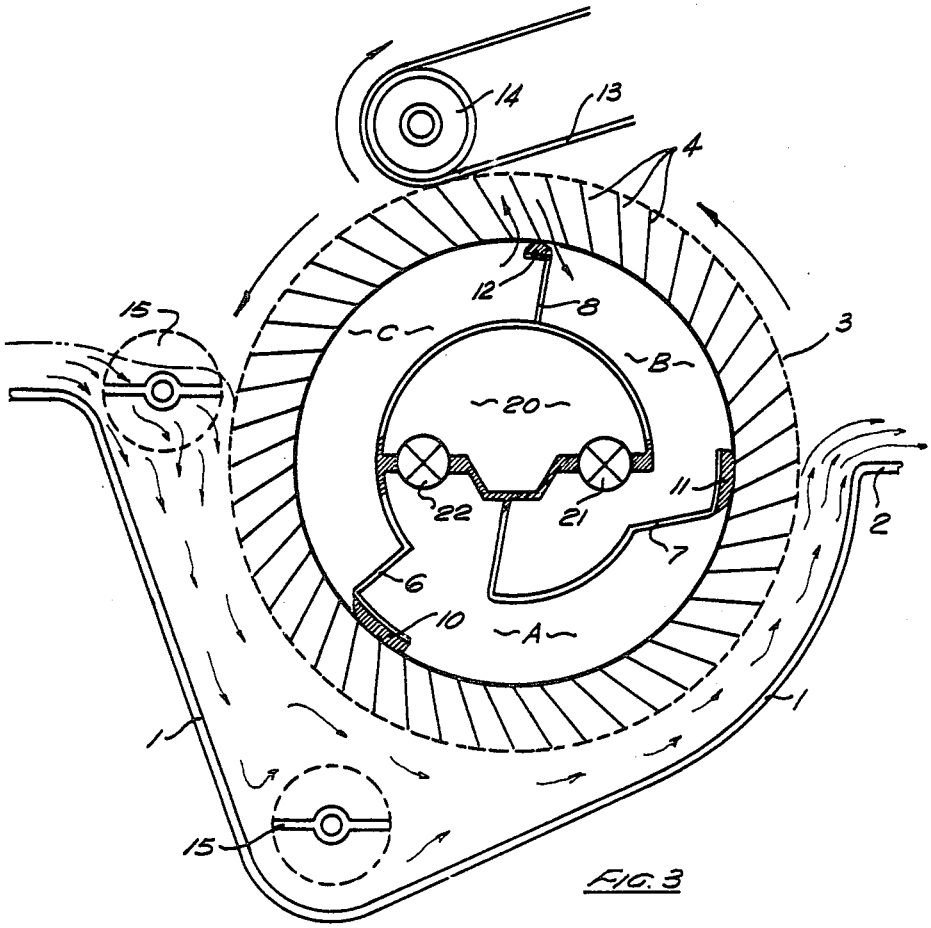
FIG. 3 is a diagrammatic cross-sectional view of a third embodiment of a vacuum sieve.

The same numerals are used in each drawing to identify parts in FIGS. 2 and 3 which correspond substantially to parts shown in FIG. 1.

The illustrated embodiment shown in FIG. 1 of the invention comprises a vat 1 adapted to hold a quantity of conventional asbestos cement slurry. The slurry is continuously fed into the vat 1, which is fitted with beaters 15 to agitate the slurry and maintain solids in suspension, and then overflows the lip 2 thereof. A cylindrical sieve 3 is mounted for rotation about a horizontal axis 16 with the lower part of the sieve submerged in the slurry.

The external mesh sheath of the sieve 3 and its manner of support and the drive means for rotating it are all of a conventional nature. However, in accordance with the invention the inner surface of the mesh sheath of the sieve has a plurality of longitudinally extending vanes 4 projecting inwardly from it and defining spaces contained between adjacent vanes able to contain a quantity of slurry liquid. Preferably vanes 4 may be directed radially inward, or orientated so that as each rises, with rotation of the cylinder from below to above a horizontal plane through the axis of the cylinder, each is sloping downwardly and inwardly of the sieve 3.

It will be understood that the spaces defined by the vanes are not closed in that each has the sieve mesh at one end thereof and is open at the opposite end thereof.

Within the cylindrical sieve 3 there are four stationary, more-or-less radially extending partitions 5 to 8 respectively.

At their radially outer edges the partitions 5,6,7 and 8 are fitted with slipper pads 9 to 12 respectively. Pads 9,10 and 11 are sufficiently long in the circumferential direction of the sieve to span a little more than two of the open ends of the spaces between the vanes 4. Thus there are always at least two vanes 4 in contact with each of the pads 9,10 and 11 at the same time and thus the pads by contact with the vanes are effective to seal the chambers defined between neighbouring partitions 5,6,7 and 8.

When the apparatus is in operation a vacuum pump extracts air from chamber A between partitions 6 and 7, which also define a film forming zone at the sieve surface, thereby causing the liquid of the slurry to travel through the outer sheath into that chamber thereby forming a layer of solids material on the outside of the sieve. Typically, pressure in chamber A is from 5" to 20" W.G. below atmospheric pressure. The liquid which flows into chamber A is carried with the sieve in the inter-vane spaces until it travels beyond pad 11 into chamber B whereupon the liquid is discharged onto the upper surface of partition 7 which is troughed to provide a launder or gutter along which the liquid may flow to the outside of the sieve where it is discharged via a conventional barometric leg seal (not shown). Chamber B is preferably maintained at from 10" to 30" W.G. and defines a dewatering zone at the sieve surface by virtue of the pressure differential at the circumference of that zone. When the layer of solids material approaches the top of the sieve it is contacted by a felt belt 13 of conventional kind rotating over couch roll 14 to be picked up and carried away with the belt in the usual manner.

To that end zone C is not under reduced pressure and for preference may be to a degree pressurized.

Zone D is vented and at atmospheric pressure.

In a preferred embodiment vanes 4 do not provide an airtight seal with the circumference of the cylinder.

Although most water is removed from the spaces between vanes 4 under the influence of gravity and pressure differential while passing through chamber B, a small amount tends to remain due to centrifugal forces. Accordingly, in preferred embodiments slipper pad 12 is shorter than the others and is flush at its trailing end with partition 8.

Since vanes 4 do not provide an airtight seal with the circumference of the cylinder 3 and since there is a pressure differential between chambers C and B a stream of air flows from chamber C over the top of vanes 4 passing adjacent to slipper 12 and into chamber B, serving to blow any water remaining between vanes 4 at the top of zone B out of the pocket and into the gutter of partition 7.

The embodiment now described with reference to FIG. 2 is suitable for use in conjunction with pipe making machinery. For that use a sieve span of at least 5 meters is desirable.

The embodiment of FIG. 2 differs from that of FIG. 1 in that a central cylinder 20 of large diameter is employed as a main vacuum manifold. This enables an internal supporting structure to have sufficient rigidity for a 5 meter span and enables small tolerances between stationary seals and the rotating vanes to be maintained.

Central cylinder 20 incorporates valves 21 and 22 along lines on opposite sides of the circumference thereof; valve 22 being in the upper portion of zone A and valve 23 being in the lower portion of zone B.

A second manifold 23 defined by partitions 7A and 7B connects with the main manifold 20 so as to apply the main vacuum to the inter vane spaces in a zone between zone A and zone B.

Two short slipper pads, 24 and 25, are located against the vanes 4 at the extremities of partitions 7A and 7B in a manner such that a high speed air flow sweeps around individual slipper pads 24 and 25 and removes excess water which has collected on the underside of the gauze carrying a thin layer or film of solids and removes water collected on the wire frame of the sieve. The design and location of pads 24 and 25 is chosen such that a maximum purging effect is obtained.

Valve 22 is controlled to provide a differential pressure in zone A, with respect to atmospheric pressure preferably, of the order of 5" to 20" W.G.

Valve 21 in zone B is controlled to maintain a differential pressure preferably in the range of 10" to 30" W.G.

Water removed from zone A in the intervane spaces is therefore removed at the second manifold 23, flows into the main vacuum manifold, and is removed therefrom via a barometric leg, any remaining water removed at zone B being collected by a gutter formed by partition 7B and similarly removed therefrom. Zone C of FIG. 1 is not needed in the embodiment of FIG. 2.

In the embodiment shown in FIG. 3 control valves 21 and 22 are relocated on main vacuum manifold 20 which in this case is not cylindrical but incorporates a gutter formation. For ease of assembly and maintenance valves 21 and 22 are preferably of a rotary type. The main vacuum manifold is designed to operate within the range 20" to 40" W.G., Zone A has an operational differential pressure with respect to atmospheric pressure of 5" to 20" W.G. controlled by valve 22 and zone B has a differential pressure maintained between 10" and 30" W.G. by valve 21. Zone C has a maximum differential pressure equal to the slurry depth at slipper pad 10.

Effluent collecting in the main vacuum manifold 20 and zone B flows gravimetrically to barometric legs connected to these zones.

Short slipper pad 12 allows for purging of intervane spaces as described in regard to the first embodiment.

The location of slipper pad 10 between zone C and zone A is selected to enable initial film building to take place under the natural head of slurry to form a precoat of film. It is significant that by varying the position of slipper pad 10, the proportion of precoat to total film may be altered thereby changing the physical properties of the film such as fibre orientation and subsequent direction of major strength.

In preferred embodiments of the apparatus, means are provided for adjusting the location of slipper pad 10 to provide adjustment and or control of film properties.

Slipper pad 11 between zones A and B is, for preference, located just below the slurry level.

This gives an adequate zone A area for film formation while enabling a gutter to be located to collect effluent lifted out of zone A by vanes 4. The length of slipper pad 11 in FIG. 3 is chosen to provide better sealing in order to restrict air flow between the two zones.

In the embodiments described the slipper pads are made of brass but other sealing means could be used, for instance, resilient pads.

Whilst described above in relation to the manufacture of asbestos cement articles it will be appreciated that the invention is applicable to any situation wherein it is required to extract solids or liquids from a liquid slurry or suspension.

In other embodiments the vanes need not be fixed to the sieve but may rotate independently, wiping the internal surface of the sieve at one extremity and adapted to seal with the walls of the vacuum chamber on passage therepast at an opposite extremity and in such circumstances the vanes may rotate at a different speed or in a different direction from the sieve surface.

As will be apparent to those skilled in the art the vanes may be varied in design, for example, by the addition of a lip on the outer edge of the vane or by utilizing a shaped vane such as a dished or convex vane.

These variations affect the efficiency of the transfer of effluent to the outlet launder.

It will also be apparent that the invention is applicable to vacuum sieve technology in a vat system which does not overflow.

We claim:

1. An apparatus for separating solids from a slurry suspension of solids and liquid, including a container adapted to hold a quantity of the slurry suspension, said apparatus comprising:

a cylindrical sieve rotatably mounted to said container, said sieve being adapted to permit passage therethrough of the liquid while substantially retaining the solids on a surface thereof while being partially immersed in the slurry;

means within said cylindrical sieve defining a stationary first reduced pressure chamber within said cylindrical sieve for applying suction to a zone on the interior side of said sieve, said interior zone being at least partially within that part of the circumference of said sieve most deeply immersed in the slurry;

means for feeding said slurry suspension to a corresponding zone on the exterior side of said sieve, whereby the solids are urged against said corresponding zone of said sieve and the liquid is urged to flow through said sieve to the interior thereof;

means within said cylindrical sieve defining a second chamber angularly spaced from said first chamber, said second chamber defining means being at least partially formed as a trough;

conveyance means comprising a plurality of liquid collection and transport means spaced around the circumference of said sieve and extending generally inwardly from the inner surface of said sieve, said liquid collection and transport means being arranged to collect some of the liquid when said liquid collection and transport means are adjacent said interior zone and being arranged to discharge at least some of the thus collected liquid onto said trough when said liquid collection and transport means are moved toward said second chamber to a position removed from adjacent said interior zone;

sealing means whereby reduced pressure may be substantially maintained in said first reduced chamber notwithstanding transportation of liquid therefrom by said liquid collection and transport means.

2. Apparatus according to claim 1 wherein said conveyance means comprises a plurality of vanes.

3. Apparatus according to claim 2 wherein said vanes extend from said sieve interior side at an angle relative to the sieve radial direction.

4. Apparatus according to claim 2 or 3 wherein said vanes are mounted on said sieve interior side and said movement adjacent said first chamber is by rotation of said sieve.

5. Apparatus according to claim 4 wherein said sealing means includes a slipper pad fixed to a stationary chamber wall, said slipper pad being always in contact with an edge of at least one vane during rotation of said sieve.

6. Apparatus according to claim 4 wherein said sealing means includes a slipper pad fixed to the stationary chamber wall, said slipper pad being always in contact with an edge of at least one vane and never in contact with the edges of more than two vanes.

7. Apparatus according to claim 1 wherein said collected liquid transported from said interior zone is discharged into an adjacent angularly spaced second stationary chamber.

8. Apparatus according to claim 7 wherein said adjacent second stationary chamber is a reduced pressure chamber and said discharged collected liquid is removed therefrom by gutter means.

9. Apparatus according to claim 1 wherein said second chamber defining means is a reduced pressure chamber having at least one wall which is adjustable with respect to a radial position at the circumference of said sieve.

10. Apparatus according to claim 1 wherein said sealing means is located adjacent to the deepest immersion point of said sieve in said slurry.

11. Apparatus according to claim 1 including a vacuum manifold which is substantially co-axial with said sieve wherein each said reduced pressure chamber communicates with said manifold through a valve.

12. Apparatus according to claim 1 wherein said liquid collection and transport means comprises a plurality of cells disposed peripherally about the internal side of said sieve and fixedly associated therewith, each said cell communicating at its outer radial end with said sieve internal side and communicating at its inner radial end during at least a part of each revolution of the sieve with one of a plurality of stationary chambers inside said sieve;

means for maintaining said second stationary chamber at a lower pressure than said first chamber, notwithstanding rotation of said sieve; and an air passage from the outer radial end of a cell which is in communication with said first reduced pressure chamber to the outer radial end of another cell which is in communication with said second chamber, whereby an air flow purges the contents, if any, of said other cell to said second chamber.

13. Apparatus according to claim 12 wherein said second chamber is adjacent to the said first reduced pressure chamber and downstream thereof with respect to the direction of rotation of said seive.

14. Apparatus according to claim 13 further comprising a third stationary chamber downstream of said second chamber, said second chamber being at a lower reduced pressure than said third chamber.

15. Apparatus according to claim 14 comprising a fourth chamber adjacent to the third chamber and downstream thereof; and means for maintaining said third chamber at a lower reduced pressure than said fourth.

16. Apparatus according to claim 13 further comprising a third chamber in communication with a zone on the internal side of said sieve having a corresponding zone on the external side of said sieve and means for feeding said slurry to said corresponding zone, wherein said second chamber is adjacent to and downstream of said third chamber and said first chamber is adjacent to and downstream of said second chamber.

17. Apparatus according to claim 12 wherein said air passage is of small cross-section in comparison with the cross-section of each said cell and the air flow in said air passage is at high velocity.

18. Apparatus according to claim 17 wherein said cells comprise a plurality of vanes extending radially from said cylindrical sieve, each said vane being spaced apart from the adjacent vane and having its radially outermost edge adjacent said sieve internal side.

19. Apparatus according to claim 18 wherein said air passage is defined between the outermost edge of each vane and the coating of solids disposed on the external side of said sieve.

20. Apparatus according to claim 19 wherein said means for maintaining said second chamber at a lower internal pressure than said first chamber comprises a slipper pad fixed to a wall separating the first chamber from said second chamber, said slipper pad contacting the inner radial edge of each successive vane as it moves therepast during rotation of said sieve, said pad being at all times in contact with at least one of said vanes.

21. Apparatus according to claim 20 wherein the length of said slipper pad is selected so that said pad cannot make contact with more than two of said vanes at a time.

22. Apparatus according to claim 20 wherein said slipper pad is adjustable in the peripheral direction.

* * * * *